US007921685B2

(12) United States Patent
Teskey

(10) Patent No.: US 7,921,685 B2
(45) Date of Patent: Apr. 12, 2011

(54) LATCH ASSEMBLY WITH SECURITY BRACKET

(75) Inventor: Gregg Teskey, Trabuco Canyon, CA (US)

(73) Assignee: Ryadon, Inc., Foothill Ranch, CA (US)

( * ) Notice: Subject to any disclaimer, the term of this patent is extended or adjusted under 35 U.S.C. 154(b) by 0 days.

(21) Appl. No.: 12/510,796

(22) Filed: Jul. 28, 2009

(65) Prior Publication Data

US 2011/0023564 A1 Feb. 3, 2011

(51) Int. Cl.
*E05B 13/00* (2006.01)

(52) U.S. Cl. ..... 70/208; 70/210; 70/417; 292/99; 292/126; 292/210; 292/216; 292/336.3; 292/337; 292/DIG. 31; 292/DIG. 41

(58) Field of Classification Search ..... 70/1.5, 70/1.7, 416–418, 333 R, DIG. 43, DIG. 56, 70/208, 210; 292/337, DIG. 41, DIG. 54, 292/336.3, DIG. 31, 126, 113, 210, 108, 292/99, 216

See application file for complete search history.

(56) References Cited

U.S. PATENT DOCUMENTS

| | | | | | |
|---|---|---|---|---|---|
| 1,118,303 | A * | 11/1914 | Meyer | 70/448 |
| 3,096,113 | A * | 7/1963 | Polzin | 292/147 |
| 4,438,964 | A * | 3/1984 | Peters | 292/216 |
| 4,548,062 | A * | 10/1985 | Kaufman | 70/417 |
| 5,042,853 | A * | 8/1991 | Gleason et al. | 292/126 |
| 5,735,558 | A * | 4/1998 | Watanabe | 292/337 |
| 5,746,457 | A * | 5/1998 | Kim | 292/216 |
| 5,813,709 | A * | 9/1998 | Umino | 292/216 |
| 6,543,821 | B1 * | 4/2003 | Weinerman et al. | 292/123 |
| 6,651,467 | B1 * | 11/2003 | Weinerman et al. | 70/208 |
| 6,692,057 | B2 * | 2/2004 | Igarashi et al. | 296/76 |

* cited by examiner

*Primary Examiner* — Lloyd A Gall
(74) *Attorney, Agent, or Firm* — Fulwider Patton LLP

(57) ABSTRACT

A latch assembly for releasably securing a closure element with a striker element in a closed position. The latch assembly consists of first and second latch elements mounted to a housing for movement relative to each other and the housing, with the first latch element being movable relative to the housing between a latched position and a release position, and cooperating structure on the release lever for moving the second latch element relative to the housing and, in response thereto, causing the first latch element to move from its latched position to its release position. A guard plate is positioned between the housing and the first latch element to more securely retain the striker element and prevent tampering or theft.

2 Claims, 2 Drawing Sheets

LATCH ASSEMBLY WITH SECURITY BRACKET

BACKGROUND

Latch mechanisms having a rotatable latch element for engaging/disengaging a striker element are common, as seen, for example, in U.S. Pat. No. 4,438,964 to Peters and U.S. Pat. No. 5,042,853 to Gleason, et al., the contents of each are fully incorporated herein by reference. While effective for latching containers and the like, these latch assemblies suffer from security issues where the locking feature can be defeated by thieves. For example, a single hook shaped retaining member such as that found in the Peters latch assembly can be defeated if the lid/latch bar can be pushed in to bypass the locking cam. This results in an unacceptable security risk where important items are to be stored.

SUMMARY OF THE INVENTION

The present invention overcomes the security issue raised above by providing a guard plate that prevents defeat of the locking cam by retaining the striker element in the locking cam when the latch is in the locked closed or locked position. The guard plate can mount to the back of the housing and comprises a surface that mounts flush to the back of the housing, and a horizontal spacing portion directed away from the housing to a position just before or after the hook portion of the locking cam. A shield plate extends vertically from the horizontal spacing portion, the shield portion having a lateral edge that cooperates with the hook portion of the locking cam to form a window enclosure for the striker element. The cooperation of the shield portion and the locking cam retain the striker element therebetween to prevent a thief, sudden impact, or other trauma from dislodging the striker element and defeating the locking mechanism.

DETAILED DESCRIPTION OF THE PREFERRED EMBODIMENTS

Figure 1:
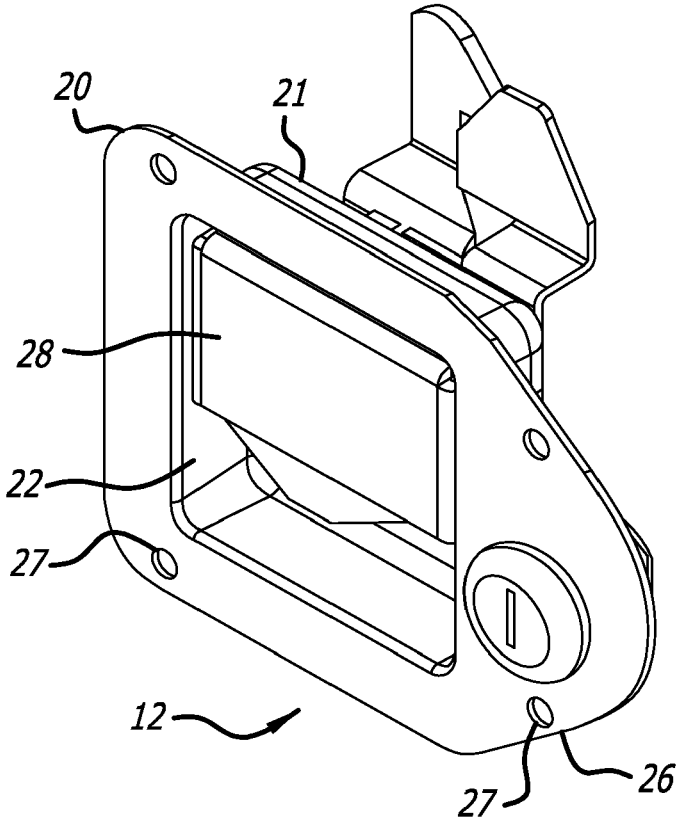
FIG. 1 is an enlarged, elevated front perspective view of the present invention.
Figure 2:
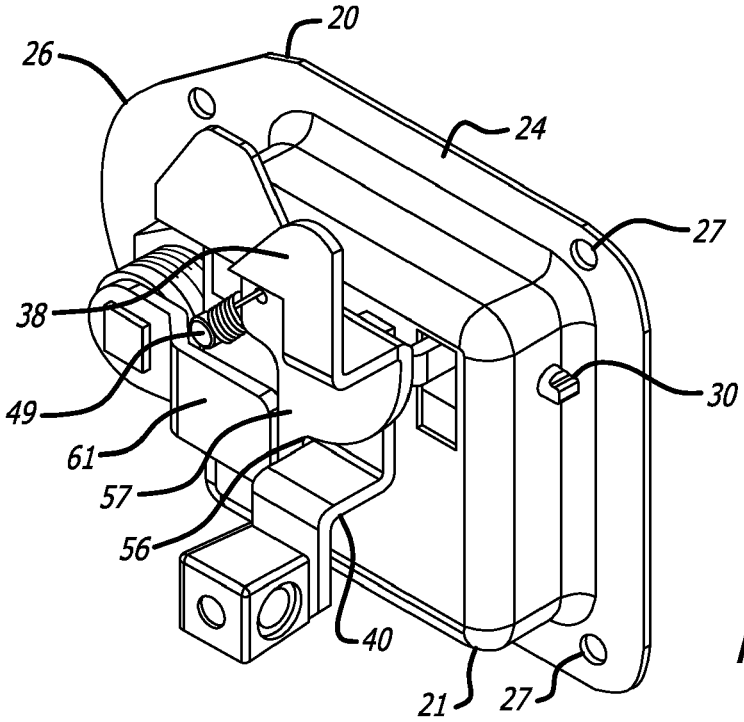
FIG. 2 is an enlarged, elevated rear perspective view of the present invention.
Figure 3:
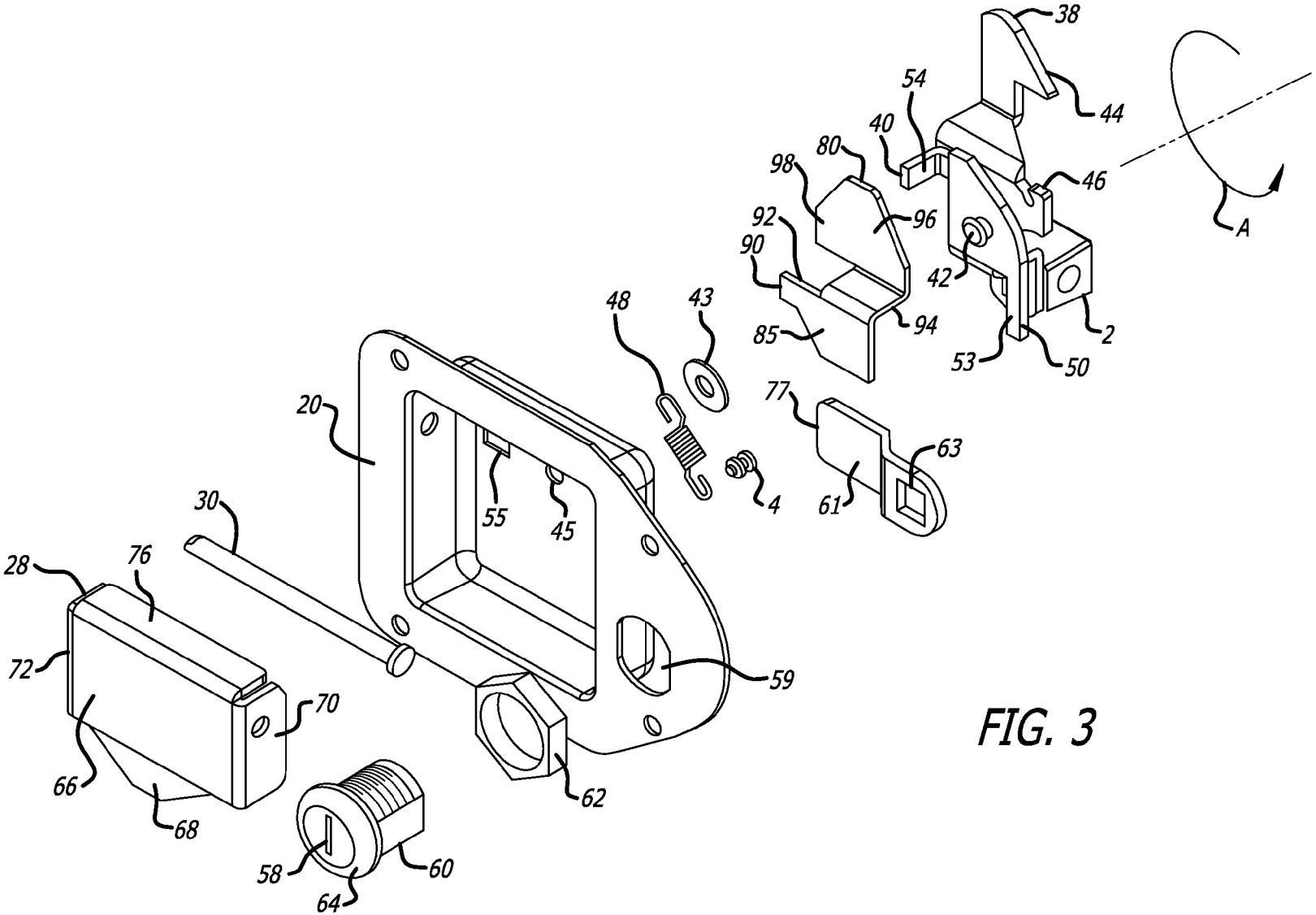
FIG. 3 is an exploded view of the present invention.

FIGS. 1-3 show a paddle latch assembly 12 for a tool box or the like, embodying the features of the present invention. The paddle latch 12 includes a housing 20 with a rectangular body 21 defining a cup-shaped recess 22 and having a peripheral mounting flange 24 with an enlarged portion 26 and a plurality of mounting holes 27 through the flange 24 for accepting screws, or the like, to fix the latch assembly 12 to the receptacle 14 of the tool box 10. A rectangular paddle/release member/lever 28 is mounted for rotation within the recess 22 about a hinge pin 30 extending through opposite walls of the body 21.

A pair of rotary cams/latch elements 38, 40 are pivotably connected at the rear face of the housing 21 by means of a rivet 42 and a spacer washer 43. The rivet 42 passes successively through the cam/latch element 38, the cam/latch element 40, the washer 43, and opening 45 in the housing 20 and is suitably anchored to the housing 20. The cam/latch element 38 has a hooked end 44 for engaging a striker bar (not shown) on the tool box lid, and a projecting finger 46. Rotary cam/latch element 40 includes a depending leg 50 and an upper offset lever arm 54 projecting through an opening 55 in the housing 20. With the latch mechanism 12 assembled, a shoulder 53 on the leg portion 50 of the rotary cam/latch element 40 abuts a confronting shoulder 56 on the rotary cam/latching element 38, thereby interengaging the cams/latching elements 38, 40 to cause the cam/latch element 38 to follow the cam/latch element 40 in an unlatching pivoting direction about the rivet 42 indicated by arrow A, i.e. in a counterclockwise direction. The cam/latch element 38 has a depending tab 57 that contacts the shoulder 56. A coil spring 48 is connected between the finger 46 on the cam/latch element 38 and a post 49 projecting from the rear face of the rectangular body 21, and acts to rotationally bias the cam/latch element 38 and interengaged cam 40 in a clockwise direction (opposite Arrow A).

A key lock 58 is mounted on the housing 20 and passes through an opening 59 on the enlarged flange portion 26. The key lock 58 and opening 59 have matched, non-circular cross sections to prevent rotation of the key lock 58 within the opening 59. The key lock 58 has a grooved lock cylinder 60 with a rotatable locking lever/arm 61 keyed to one end thereof by means of a lock washer 62 and keyway 63 in the locking lever/arm 61.

The paddle/release member 28 has a front face 66 defining a graspable handle 68, a pair of spaced sidewalls 70,72 for engaging the hinge pin 30, and a top wall/flange 76. The pin 30 guides movement of the paddle/release member 28 between a normal position, shown in FIG. 1, and a release position in which the handle is rotated about the pin 30. In operation, the flange 76 engages the lever arm 54 of the rotary cam/latch element 40 projecting through the opening 55 in the housing 20. As a rotative force is applied to the handle 68, the paddle/release member 28 is rotated about the hinge pin 30, with the flange 76 forcing the lever arm 54 downwardly and thereby rotating the rotary cam 40 about the pivot 42. Due to the engagement of the shoulders 56, 53 on the cams/latch elements 38, 40, rotation of the cam/latch element 40 induced by actuation of the paddle 28 results in rotation of the cam 38 from a latched position, shown in FIG. 2, to a release position in which hook end 44 rotates counterclockwise to thereby disengage the hooked end 44 of the cam/latch element 38 from the striker element (not shown) on the tool box lid. The tool box is thereby unsecured and may be opened.

A restoring force is continuously applied to the cam/latch element 38 by the spring 48. As the cam/latch element 38 is rotated out of engagement with the striker 18, the spring 48 is extended and acts to apply a restoring force to the cam/latch element 38. Once the handle 68 is released to its normal position, the spring 48 acts to rotate the interengaged cams/latch elements 38,40 in a clockwise direction in FIG. 3.

The locking lever/arm 61 of the key lock 58 may be rotated by actuation of an external key (not shown) between a locked position wherein the free end 77 of the locking lever/arm 61 confronts the leg 50 of the rotatable cam/latch element 40 and thereby blocks the path of the cam/latch element 40 from its engaged to its disengaged position. When one attempts to actuate the handle 68 of the paddle/release member 20 with the locking lever/arm 61 in its locked position, the flange 76 of the paddle/release member 28 abuts the lever arm 54 of the fixed cam/latch element 40 but cannot displace the lever arm 54 due to the blocking function of the free end 77 of the locking lever/arm 61, preventing rotation of the paddle/release member 28 about the hinge pin 30. In order to disengage the hooked end 44 of the cam/latch element 38 from the striker element, it is necessary to rotate the locking lever/arm 61 out of its locked position to thereby allow the paddle/ release member 28 to rotate and effectuate rotation of the interengaged cams/latching elements 38,40.

A guard plate 80 is mounted to the back of the housing for enclosing the striker element with the hook end 44 when the latch is in the locked position. Without the guard plate 80, the striker element can be displaced from the hook end 44 of the cam 38 by various forces, such as projecting a tool through the opening 55 or by pushing heavily on the housing back and forth. The guard plate 80 has a lower section 85 that attaches to the rear of the housing, such as by welding, adhesive, rivet, fastener, or the like. The lower section 85 may include a projecting arm 90 that extends to the cam 40 and behind the finger 46 of the cam 38. Extending from the upper edge 92 of the lower section 85 of the guard plate 80 is a spacer section 94 that horizontally offsets the upper portion 96 adjacent the hook end 44 from the lower portion 85 mounted against the housing 20. The upper portion 96 projects vertically from an end of the spacer section 94, and includes a vertical edge 98 that extends to the hook end 44 of the cam 38. The vertical edge 98 cooperates with the hook end 44 to form a window that captures the striker element when the cam 38 is rotated in the position shown in FIG. 2. With the guard plate in place, a striker element cannot be dislodged or pried away from the hook member as was the case with the prior art systems. In this manner, the latch assembly is more securely locked to prevent theft and accidental dislodgement of the striker element.

I claim:

1. A latch assembly for releasably securing a closure element having a striker element in a closed position where the latch assembly includes a housing, a release lever having a normal position and a release position, first and second latch elements, said first latch element having a hooked end portion for engaging the striker element for maintaining the closure element in its closed position, said first latch element being movable relative to the housing between a latched position in which it maintains the closure element in its closed position by capturing the striker element and a release position in which the closure element can be moved out of its closed position by releasing the striker element, there being cooperation between the release lever and first and second latch elements to move the second latch element relative to the housing and, in response thereto, causing the first latch element to move from its latched position to its release position, the latch assembly further comprising:

a guard plate having a lower portion, a spacer portion, and an upper portion, the lower portion defining a first plane and being fixedly mounted to the housing of the latch assembly, the lower portion further comprising a projecting arm extending to a cam on the first latch element, the spacer portion defining a second plane extending transversely with the first plane and extending away from the housing, and the upper portion defining a single plate with a base that is wider than a top edge, the single plate having a first and second lateral edges each having a vertical portion and an inwardly inclined portion leading to a horizontal top edge, wherein a first lateral edge cooperates with the first latch element to enclose the striker element when the first latch element is in the latched position.

2. The latch assembly of claim 1 further comprising a locking element mounted to the housing and adapted to selectively prevent the first latch element from transitioning from the latched position to the release position.

* * * * *